US005125848A

United States Patent [19]

Zimmerly

[11] Patent Number: 5,125,848

[45] Date of Patent: Jun. 30, 1992

[54] ENVIRONMENTALLY SEALED HERMAPHRODITIC ELECTRIC CONNECTOR

[75] Inventor: Robert D. Zimmerly, Kenosha, Wis.

[73] Assignee: Tri-Clover, Inc., Kenosha, Wis.

[21] Appl. No.: 662,233

[22] Filed: Feb. 28, 1991

[51] Int. Cl.[5] ..... H01R 13/28; H01R 13/52

[52] U.S. Cl. ..... 439/291; 439/290; 439/287; 439/523; 439/730

[58] Field of Search ..... 439/281, 284, 287, 289–291, 439/519, 523, 588, 589, 730

[56] References Cited

U.S. PATENT DOCUMENTS

| | | | |
|---|---|---|---|
| 3,086,188 | 4/1963 | Ross | 439/291 |
| 3,489,987 | 1/1970 | Niskin | 439/287 |
| 3,594,695 | 7/1971 | Wofford | 339/49 |
| 4,701,133 | 10/1987 | Worth | 439/292 |
| 4,923,413 | 5/1990 | Michaels | 439/284 |

*Primary Examiner*—Paula A. Bradley

*Attorney, Agent, or Firm*—Fuller, Ryan, Hohenfeldt & Kees

[57] ABSTRACT

An electrical connector assembly is formed of opposed hermaphroditically mating connectors, having two or more pairs of alternating male and female contact members. Each female contact member is carried by and disposed at the outer end of a linear elongated insulating member projecting from the end of the plug. The insulating members in cross-section are each in the configuration of a sector of a circle having a truncated central edge. The male contact members are disposed between the elongated insulating members. The elongated insulating members are so configured that when two of the connectors are mated together the elongated members will form a cylindrical shape. The connectors will mate together only in one orientation due to the fact that at least one of the elongated insulating members forms an arcuate part of the circumference of a circle that has a different length than at least one of the other elongated members. The connectors are protected from the environment in three separate ways, the position of the female contact within the elongated insulating members, a snap-in-place sleeve element that engages grooves on the outer surface of the plug members, and a shroud of heat shrinkable material.

7 Claims, 1 Drawing Sheet

ENVIRONMENTALLY SEALED HERMAPHRODITIC ELECTRIC CONNECTOR

FIELD OF THE INVENTION

This invention relates to electrical connectors and more particularly to hermaphroditic plugs for connecting four or more wires which are protectively sealed from the environment.

BACKGROUND ART

Numerous designs exist for electrical plug connectors including those of hermaphroditic designs. See for example U.S. Pat. No. 4,701,133 issued Oct. 20, 1987 or U.S. Pat. No. 3,594,695 issued Jul. 20, 1971. Various means have been employed also to protect such connectors from the environment. One such solution has been to utilize a curable potting compound which can cure in place around a connection. Another solution has been to use heat shrinkable materials wrapped around the connection. See for example U.S. Pat. No. 4,923,413 issued May 8, 1990.

A need has continued to exist for a plug configuration which can connect together four or more wires in a hermaphroditic manner such that any two wires in an installation can be connected together at either end and which are adequately sealed from the environment so that failures resulting in costly shut-downs of plant or equipment are minimized. It is the principal object of the present invention to meet the need for such a plug.

Briefly summarized, the present invention provides an electrical connector assembly formed of opposed mating connectors. Each of the connectors is substantially identical so that it can be hermaphroditically mated to any of the other plug members. The plug members of the present invention have two or more pairs of alternating male and female contact members. In accordance with the invention, each female contact member is carried by and disposed at the outer end of a linear elongated insulating member projecting from the end of the plug. The insulating members in cross-section are each in the configuration of a sector of a circle having a truncated central edge. The male contact members are disposed between the elongated insulating members. The elongated insulating members are so configured that when two of the connectors are mated together the elongated members will form a cylindrical shape. The connectors will mate together only in one orientation due to the fact that at least one of the elongated insulating members forms an arcuate part of the circumference of a circle that has a different length than at least one of the other elongated members.

The connectors of the present invention are protected from the environment in three separate ways. Firstly, such protection is provided by placement of the female contact members within the elongated insulating members. Secondly, the plugs are provided with a snap-in-place sleeve element that engages grooves on the outer surface of the plug members. Finally, the outer surface of the sleeve is sealed within a shroud of heat shrinkable material, in the preferred embodiment. Raised ridges are provided around the bases of the plugs to provide surfaces for the shroud to engage mechanically after shrinking.

DETAILED DESCRIPTION

Referring more particularly to the drawings, there is seen an electrical connector assembly 10 which includes opposed mating connectors 12 and 14 attached to electrical lead lines 13 and 15, respectively. It will be noted that connectors 12 and 14 are of an identical hermaphroditically mating configuration such that any two connectors can be attached to each other. A further characteristic of connector assembly 10 is that any pair of connectors 12 and 14 can be connected together in only one rotational orientation with respect to each other.

Figure 4:
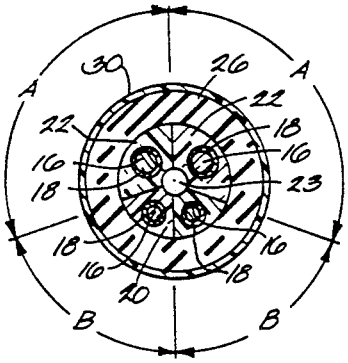
FIG. 4 is a cross-sectional view taken along line 4—4 of FIG. 3.

It will be noted that each of connectors 12 and 14 include alternating male contact members 16 and female contact members 18. Each of the female contact members 18 is carried by and disposed at the outer end of a linear elongated insulating member 20. As best seen in FIG. 4, each of the elongated insulating members 20 and 22 has its central edge truncated in order to avoid difficulty in sliding the two connectors together and to facilitate molding of the components. While a concave, circular-shaped truncation is shown in the drawings, it will be appreciated that the truncation can be flat or convexly shaped rather than concavely shaped as shown. Also, as seen in FIG. 4, the connectors when mated together, collectively form a cylindrical shape. Due to the fact that at least one of the elongated members 20 forms an arcuate part of the circumference of the circle, angle A, that is different in length than that of at least one of the other elongated members 22 which forms an arcuate part of different length, angle B, the plug can be mated together in only one orientation.

While the preferred embodiment shown in the drawings shows two pairs of connectors on each plug, the invention can also be applied to plugs wherein a greater number of pairs of connectors are used, for example, three, four, or a greater number of pairs. So long as at least one elongated insulating member and the corresponding void space surrounding the male connector on the opposite side of the connector is of a different arcuate length, the connectors will be hermaphroditically mateable in but a single orientation with respect to each other.

Figure 2:
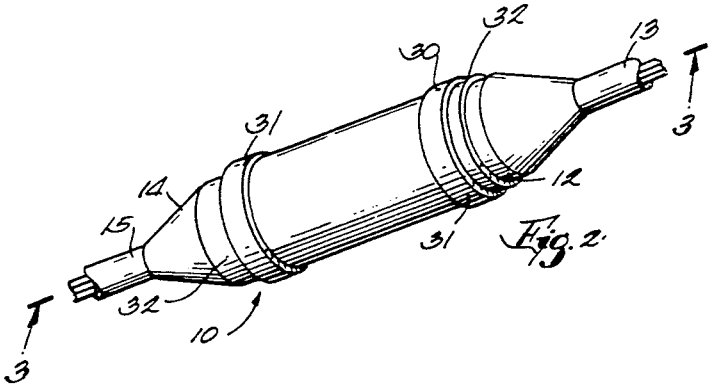
FIG. 2 is an isometric view of two plugs connected together with environmental sealing means in place thereon.
Figure 3:
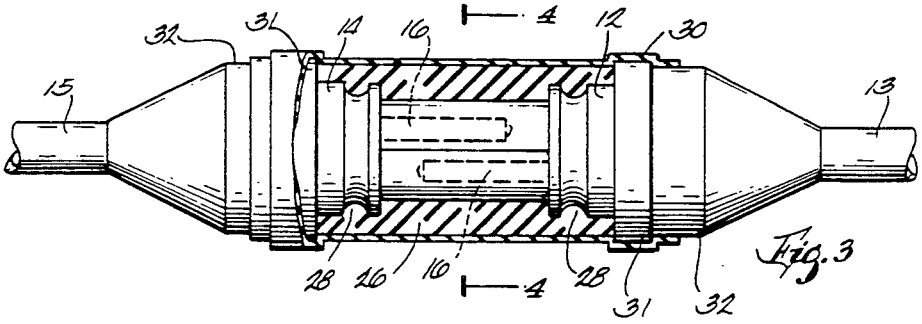
FIG. 3 is a cross-sectional view taken along line 3—3 of FIG. 2.
Figure 1:
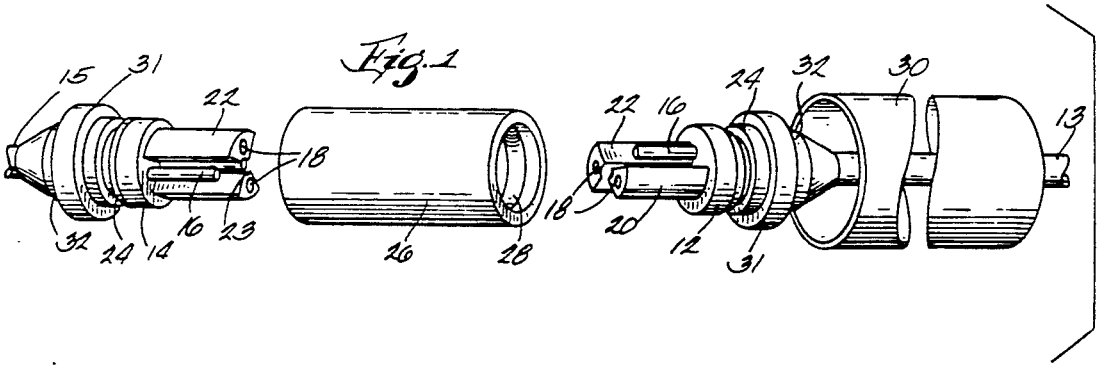
FIG. 1 is an isometric view showing two plugs of the present invention in disconnected relationship.

A circumferential groove 24 is provided near the base of each of the connectors 12 and 15 in order to receive a mating protrusion 28 on the interior of a sleeve 26 which is snapped into place when the connectors are mated. To further seal the connector assembly from the environment, a shroud 30 of heat shrinkable plastic material can be provided as seen in FIG. 1. Raised ridges 31 extending above the surfaces of the base 32 of the connectors 12 and 14 are provided in order to form surfaces around which the heat shrink film can mechanically lock upon shrinking. Such locking assists in avoiding inadvertent separation of the plugs. After heat shrinking is in place as seen in FIGS. 2 and 3, shroud 30 provides a final seal against environmental contamination such as moisture. Thus, it will be appreciated that the plug assembly of the present invention is triply protected against damage from the environment while still remaining disconnectable for replacement or repair when that becomes necessary. Sleeve 26 and shroud 30 can be formed of any suitable electrically insulating and environmentally stable materials. Moldable elastomers of conventional composition are generally used for plug members 12 and 14.

The connector assemblies of the present invention have been found to be particularly suitable for cable systems to connect together, electronic controls, valves and the like in manufacturing plants. Other applications will, however, be readily apparent. The invention has been described with respect to preferred embodiments. It is apparent that various changes can be made without departing from the scope of the invention as defined by the appended claims.

What is claimed is:

1. An electrical connector assembly comprising opposed mating connectors, said connectors comprising substantially identical hermaphroditically mating plug members each of which has two or more pairs of alternating male and female contact members, each female contact member being carried by and disposed at the outer end of a linear elongated insulating member, each of said insulating member, in cross-section, being in the configuration of a sector of a circle with the central edge thereof being truncated in an amount sufficient to facilitate sliding together of the members, the male contact members being disposed between said elongated insulating members, the elongated members of two of said connectors, when mated together, forming a cylindrical shape, at least one of the elongated members on each plug member forming an arcuate part of the circumference of said circle of a different length than at least one of said other elongated members, whereby said plug can be mated together in only one orientation each plug being provided with a circumferential groove and a cylindrical protective sleeve having internal ridges engageable in said grooves being provided to envelope the connecting part of said plug assembly.

2. An assembly according to claim 1 further provided with an enveloping shroud of heat-shrinkable plastic material around said plug and said sleeve.

3. An assembly according to claim 2 wherein the base of each of said plug members is provided with a ridge raised above the surface thereof to form a means to anchor said shroud thereto after shrinking.

4. An electrical connector assembly comprising opposed mating connectors, said connectors comprising substantially identical hermaphroditically mating plug members each of which has two pairs of alternating male and female contact members, each female contact member being carried by and disposed at the outer end of a linear elongated insulating member, each of said insulating members, in cross-section, being in the configuration of a sector of a circle containing a single contact member with the central edge thereof being truncated in an amount sufficient to facilitate sliding together of said members, the male contact members being disposed between said elongated insulating members, the elongated members of two of said connectors, when mated together, forming a cylindrical shape, said elongated members on each plug member forming unequal arcuate parts of the circumference of said circle, whereby said plug can be mated together in only one orientation wherein each plug is provided with a circumferential groove and a cylindrical protective sleeve is provided with internal ridges engageable in said grooves is provided to envelope the connecting part of said plug assembly.

5. An assembly according to claim 4 further provided with an enveloping shroud of heat-shrinkable plastic material around said plug and said sleeve.

6. An assembly according to claim 5 wherein the base of each of said plug members is provided with a ridge raised above the surface thereof to form a means to anchor said shroud thereto after shrinking.

7. An electrical connector assembly comprising opposed mating connectors, said connectors comprising substantially identical hermaphroditically mating plug members each of which has two or more pairs of alternating male and female contact members, each female contact member being carried by and disposed at the outer end of a linear elongated insulating member, each of said insulating members, in cross-section, being in the configuration of a sector of a circle with the central edge thereof being truncated, the male contact members being disposed between said elongated insulating members, the elongated members of two of said connectors, when mated together, forming a cylindrical shape, at least one of the elongated members on each plug member forming an arcuate part of the circumference of said circle of a different length than at least one of said other elongated members, whereby said plug can be mated together in only one orientation, each plug being provided with a circumferential groove and a cylindrical protective sleeve provided with internal ridges engageable in said grooves, said sleeve enveloping the connecting part of said plug assembly, said assembly being further provided with an enveloping shroud of heat-shrinkable plastic material around said plug and said sleeve.

* * * * *

UNITED STATES PATENT AND TRADEMARK OFFICE

CERTIFICATE OF CORRECTION

PATENT NO. : 5,125,848

DATED : June 30, 1992

INVENTOR(S) : Robert D. Zimmerly

It is certified that error appears in the above—identified patent and that said Letters Patent is hereby corrected as shown below:

Column 3, line 27:

Delete "member" and substitute --- members ---.

Signed and Sealed this

Twenty-eighth Day of September, 1993

Bruce Lehman

*Attest:*

BRUCE LEHMAN

*Attesting Officer*

*Commissioner of Patents and Trademarks*